US005577863A

United States Patent [19]

Nottle

[11] Patent Number: 5,577,863

[45] Date of Patent: Nov. 26, 1996

[54] SELF-ACTUATING SLUICE GATE

[76] Inventor: Murray K. Nottle, 1294 Toorak Road, Burwood, Victoria 3125, Australia

[21] Appl. No.: 397,041

[22] PCT Filed: Aug. 20, 1993

[86] PCT No.: PCT/AU93/00426

§ 371 Date: Feb. 14, 1995

§ 102(e) Date: Feb. 14, 1995

[87] PCT Pub. No.: WO94/00426

PCT Pub. Date: Mar. 3, 1994

[30] Foreign Application Priority Data

Aug. 24, 1992 [AU] Australia ..... PL4236

[51] Int. Cl.[6] ..... E02B 3/00; E02B 7/00; E02B 8/00; E02B 7/40

[52] U.S. Cl. ..... 405/87; 405/80; 405/92; 405/99; 405/100; 405/101

[58] Field of Search ..... 405/80, 87, 92, 405/99, 100, 101

[56] References Cited

U.S. PATENT DOCUMENTS 1,986,701 1/1935 Zimmermann ..... 405/87
3,372,549 3/1968 French ..... 405/92
3,756,032 9/1973 Solinas ..... 405/92
4,103,497 8/1978 Colamussi et al. ..... 405/101 X

FOREIGN PATENT DOCUMENTS 002685367 6/1993 France ..... 405/80

*Primary Examiner*—Tamara L. Graysay
*Assistant Examiner*—Tara L. Mayo
*Attorney, Agent, or Firm*—James Ray & Associates

[57] ABSTRACT

A sluice gate for controlling the discharge of water through a gateway in a flood irrigation system mounted with stub axles defining a hinge axis upstream of the gateway, and comprising a closure element mounted for swing movement about that axis and able to swing from a lower position wherein it blocks the gateway to an upper position wherein it allows water to flow through the gateway, a chamber integral with the closure element, a filler opening through which water from the upstream side of the gateway may enter the chamber, a drain opening that is larger than the filler opening through which water may drain from the chamber to the downstream side of the gateway, and a battery powered solenoid valve, having an actuator responsive to a radio signal from a remote water sensor, controlling the flow of water from the chamber through the drain opening.

5 Claims, 3 Drawing Sheets

SELF-ACTUATING SLUICE GATE

TECHNICAL FIELD

This invention relates to sluice gates, that is to say, gates for controlling the discharge of liquid from a high level source, such as, for example, a volume of liquid impounded by a weir or the like.

The invention was devised primarily for controlling the discharge of irrigating water from a farm dam, main supply channel or the like onto land to be irrigated or into a subsidiary distributor channel or the like in a flood irrigation reticulation system. Therefore it is described hereinafter primarily with regard to that application, however it will be appreciated that the invention is applicable to sluice gates for the release of impounded liquid generally.

BACKGROUND ART

Hitherto farmers have usually opened and closed sluice gates manually to release water from an impounded supply, distribution channel or the like onto land to be irrigated. The gates themselves have frequently comprised a closure element in the form of a flat leaf able to be raised or lowered bodily in upright guides at each side of a gateway, in the manner of a portcullis, to control flow through the gateway. In other instances swinging leaf gates analogous to conventional double doors have been used. It is also known to use portcullis type gates wherein the closure element is an arcuate leaf that swings up and down about a horizontal axis rather than sliding in guides as aforesaid.

It is known to use portcullis type gates wherein the closure element is a hollow body that may be filled with, and emptied of, water to assist in the lifting and lowering of same.

DISCLOSURE OF THE INVENTION

The farmer's aim is to release as much water as required and no more, not only to conserve water but also to contain costs. Unfortunately the quantity of water required for a particular field in any instance is somewhat indeterminate. It depends on the nature of the crop, the initial moisture content in the soil, the sunniness and windiness of the weather at the time, and so on. The result is that the farmer cannot readily plan ahead to release water to a time schedule, not only in view of those variables but also in view of the variable and maybe indeterminate nature of the flow rate for any particular setting of the gate.

Devices are known which monitor a field and respond to water to close an electric circuit or otherwise actuate a remote indicator. These may be used by the farmer to let him know when it would be appropriate to close the relevant sluice gate or gates, but this may often occur at night or other inconvenient time.

Thus, there is a need for self-actuating sluice gates, particularly for small, inexpensive gates suitable for use as feeder gates in open channel, farm irrigation systems, that may close in response to a signal from such a monitoring device, or to a similar signal sent from a remote signal generator under manual control, and an object of the present invention is to provide a sluice gate having that capability.

Having regard to the cost of distributing electrical power on farms it is desirable for the gate to use a self-contained, stored energy, power source. In preferred embodiments, that power source is a battery that is kept charged by a small solar panel on or near the gate. This requires the gate to draw only little power from the power source, and another object of the invention is to provide a gate having that capability.

This latter object is met by providing a gate that opens and closes under the influence of a water ballasted float which may fill from the high level source and drain to the low level outflow, wherein the only external power needed is that required to operate valve means controlling the flow of ballast water into or from the float.

A further object attained by preferred embodiments of the invention is to provide a self-actuating gate meeting the above mentioned desiderata that may be retro-fitted to existing or known sluice gateways of the kind found in open channel farm irrigation systems, and which are adapted to accommodate the presently used, manually operable, planar leaf, portcullis type gates.

The invention consists in a sluice gate for controlling the discharge of liquid through a gateway, comprising mounting means defining a fixed substantially horizontal hinge axis upstream of the gateway, a closure element mounted for swing movement about that axis and able to swing from a lower position wherein it blocks said gateway to an upper position wherein it allows liquid to flow through the gateway, a buoyancy chamber fixedly associated with the closure element, a filler opening through which liquid from the upstream side of said gateway may enter said chamber, a drain opening through which liquid may drain from said chamber to the downstream side of said gateway, valve means controlling the flow of liquid through at least one of said openings, and valve actuator means responsive to a signal from a remote control means.

In preferred embodiments only one of said openings is valve controlled, and the arrangement is such that when the valve means is open, the flow through the valve controlled opening exceeds the flow through the other, uncontrolled opening.

By way of example, an embodiment of the above described invention is described in more detail hereinafter with reference to the accompanying drawings.

BEST MODE OF CARRYING OUT THE INVENTION

Figure 1:
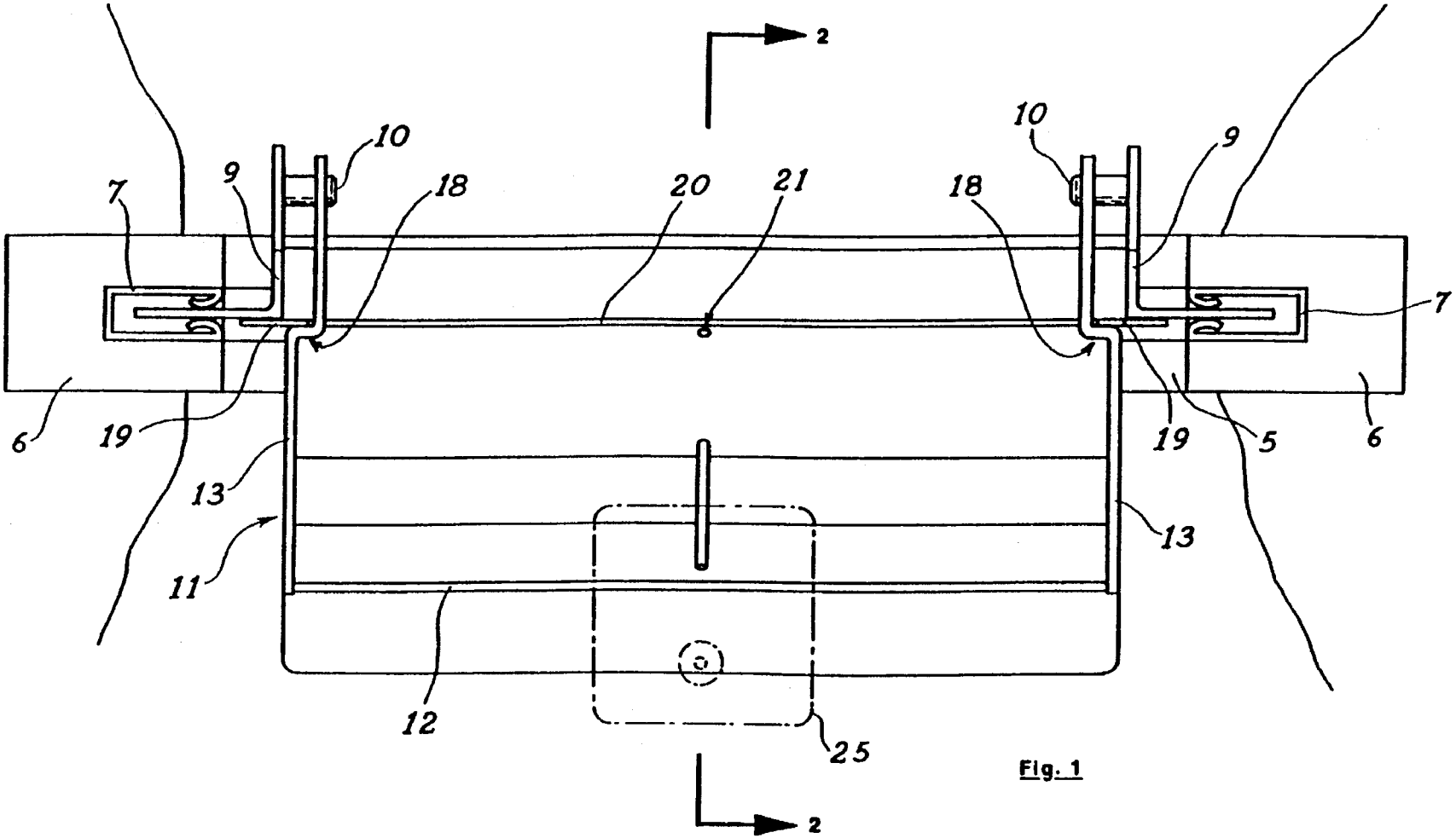
FIG. 1 is a plan view of a sluice gate according to the invention.

The illustrated embodiment is shown retro-fitted into a conventional gateway in an irrigation channel. That gateway comprises a U-shaped concrete structure comprising a horizontal base member 5 and two gateway side members 6. That concrete structure, or a timber or other equivalent thereof, is incorporated in an impounding bank, or a wall of a water supply channel, or in the floor and walls of such a channel, in conventional manner so that discharge of impounded water may be effected only through the gateway.

The members 5 and 6 house channel sectioned elastomeric seals 7 with inturned lips. In a conventional sluice gate, a simple planar closure leaf, for example a rectangular sheet of steel, would be positioned so that its side edge margins reside within the seals 7 in the side members 6 and its bottom edge margin resides within the seal 7 in the base member 5. Thus, the seal lips normally engage the side faces of the leaf to prevent substantial leakage, and they function as guides enabling the leaf to be slid upwardly, or entirely removed, to allow flow through the gateway.

In the exemplary embodiment of the invention now being described mounting means are provided comprising a U-shaped frame of angle sectioned members, namely a horizontal bottom member 8 and upright side members 9. Those frame members are joined together in a manner providing a continuous flange that projects outwardly in the plane of the frame and thus is able to enter the seals 7 in exactly the same manner as do the edge margins of a conventional planar leaf. Thus, the mounting means are held in place by, and are sealed against, the existing gateway; so that they effectively become a part of the gateway defining a slightly smaller discharge passage for the sluice gate than would be the case in their absence.

The side members 9 have further flanges extending perpendicularly from the plane of the gateway in the upstream direction. Those last mentioned flanges carry stub axles 10 that define a substantially horizontal hinge axis for a closure element 11.

Figure 2:
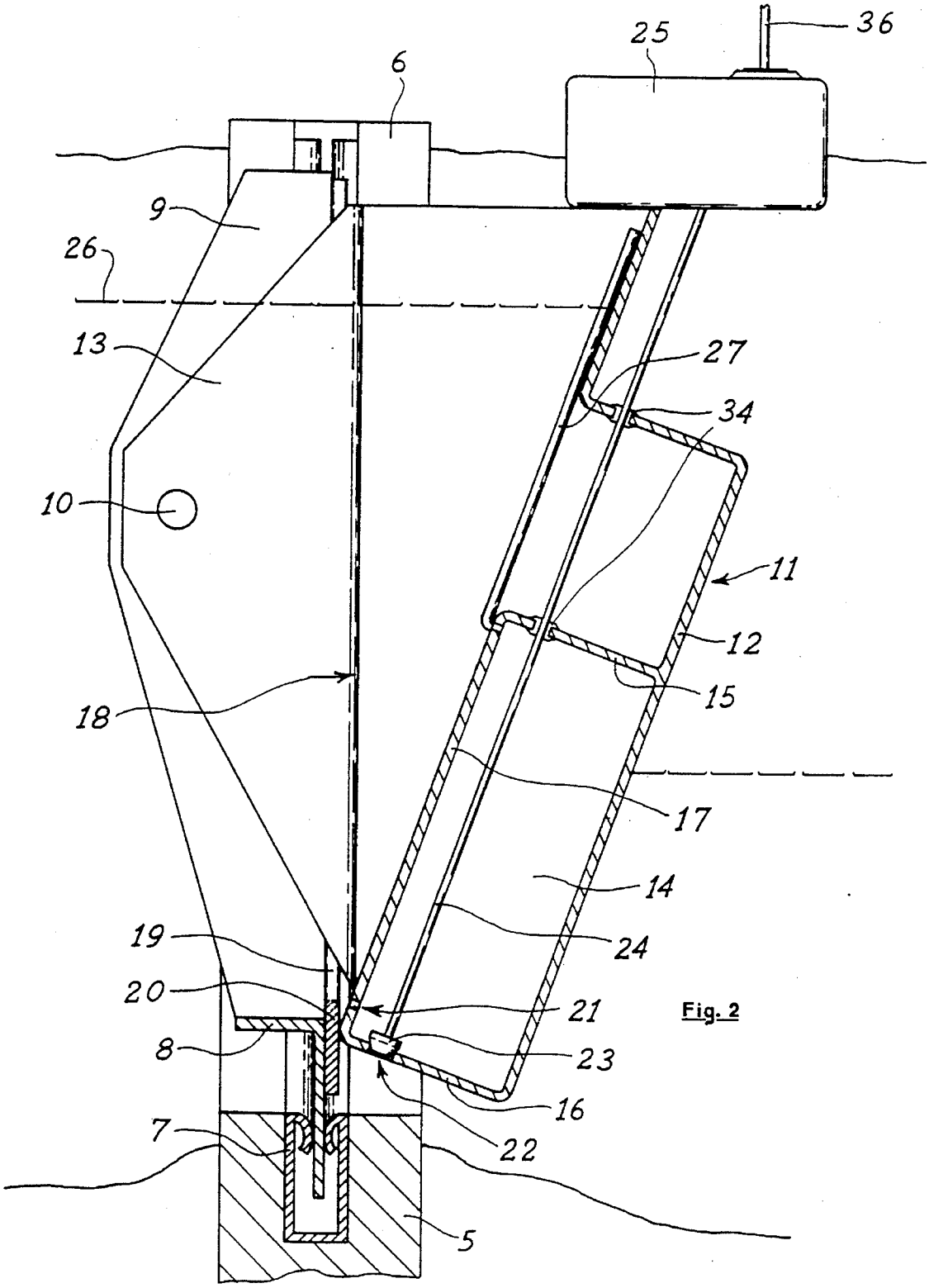
FIG. 2 is a sectional view taken on line 2—2 of FIG. 1.
Figure 4:
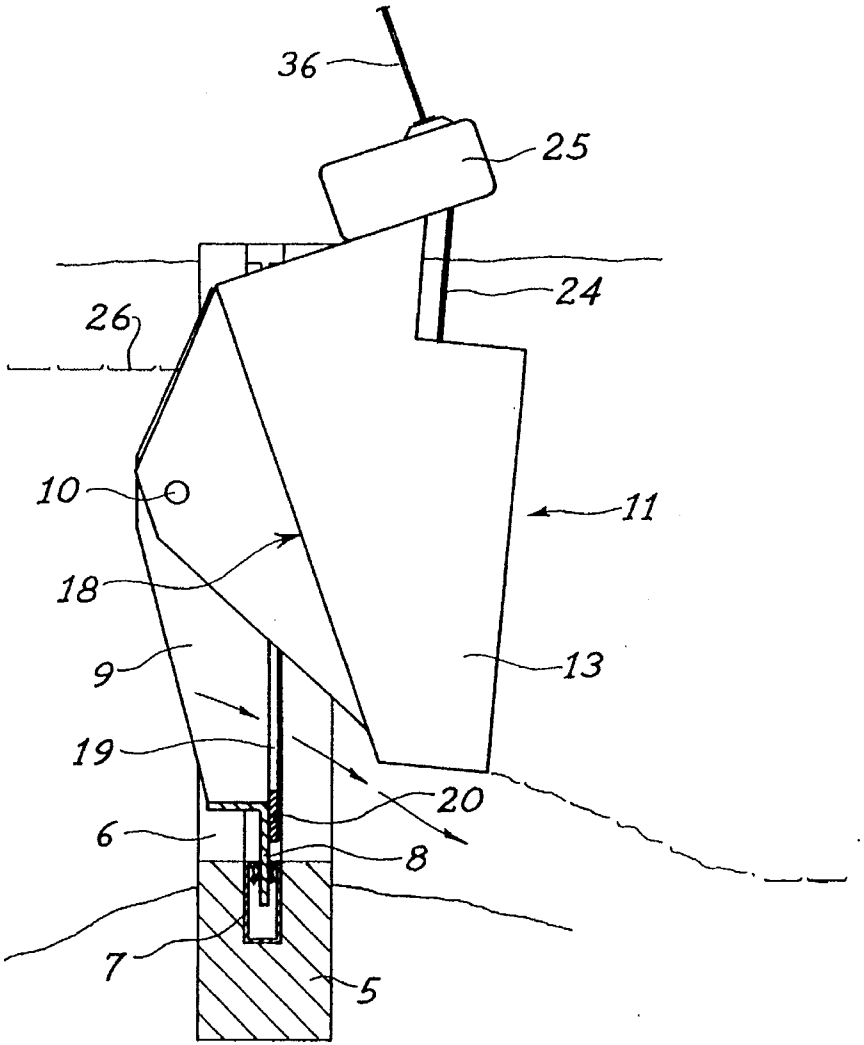
FIG. 4 is a view similar to FIG. 3 showing the sluice gate of that figure when open.
Figure 3:
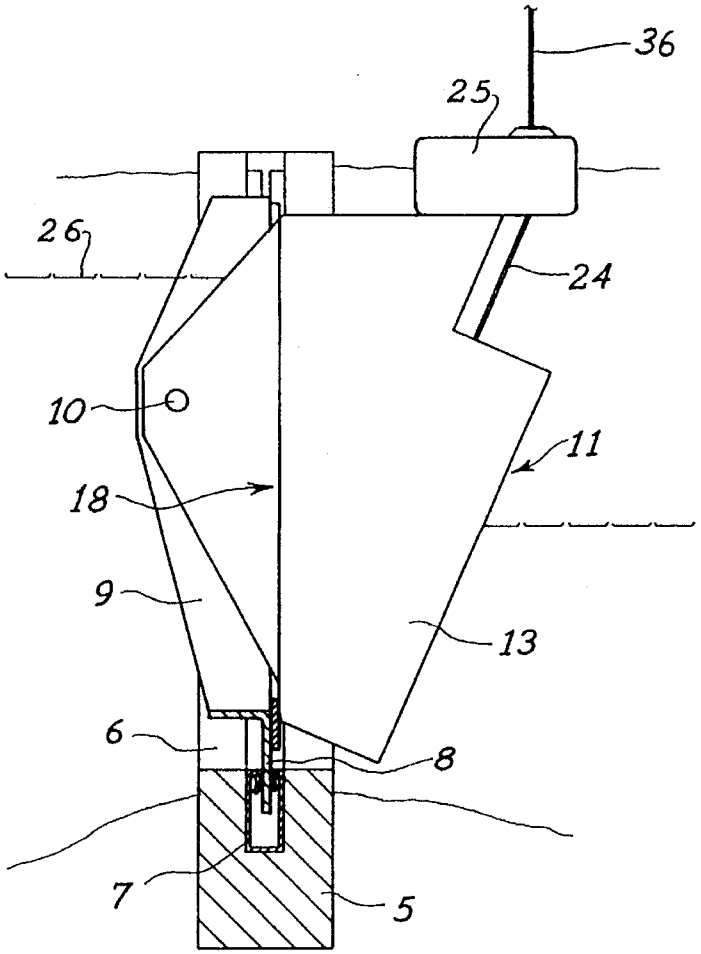
FIG. 3 is a partly sectioned side elevation of the sluice gate of FIG. 1 when closed, drawn to a smaller scale.

The closure element 11 comprises a rear wall 12 and two forwardly projecting wings 13. Those wings are pierced by the stub axles 10, so that the closure element 11 as a whole may swing on those axles between a lower position (as seen in FIGS. 1, 2 and 3) and an upper position (as seen in FIG. 4).

The closure element 11 incorporates an integral buoyancy chamber 14 defined by lower parts of the rear wall 12 and wings 13, a chamber roof 15, a chamber floor 16, and a chamber front wall 17. The chamber 14 is vented to atmosphere, for example by a vent tube 27 extending to above the high water level 26, to enable the inflow and outflow of water ballast.

Each of the wings 13 is stepped at 18 to provide lands on the wings adapted to seal against resilient elastomeric sealing strips 19 adhered or otherwise fastened to the side members 7 of the frame. Likewise, a lower front corner portion of the chamber 14, that is to say a narrow horizontal zone of the chamber's outer surface at or near the junction between the chamber floor 16 and its front wall 17, is able to seal against a further such sealing strip 20 adhered to the bottom member 7 of the frame. Thus, when the closure element is in its lower position it effectively blocks the discharge passage defined by the frame. On the other hand, when the closure element is in its upper position, water may readily flow through the gateway under the closure element.

A small hole 21, constituting a filler opening for the chamber 14, pierces its front wall 17 near the floor 16, and a larger hole 22, constituting a drain opening for the chamber, pierces its floor 16 near the front wall 17. The filler hole 21 is permanently open, whereas the drain hole 22 is able to be plugged by a valve plug 23 on an axially movable valve stem 24 extending through guides 34 in the rear wall 12 and chamber roof 15 into a mechanism housing 25 mounted on the closure element 11 above the water level 26 upstream of the sluice gate.

The housing 25 may contain an operating solenoid and plunger adapted to lift the valve stem 24, a totally enclosed maintenance free battery and a solid state switching circuit responsive to a radio signal received by an antenna 36. The switching circuit may be of the flip-flop or latching type such that if the solenoid is de-energised when a signal is received the circuit operates to energise the solenoid from the battery, whereby the valve stem is lifted, until a further signal is received causing a return to the original condition.

Preferably, the top surface of the housing 25 carries an array of solar cells in association with a diode whereby the battery is kept in a charged condition. Such battery and battery charging arrangements are well known, being widely used on farms in relation, for example, to electric fences.

Thus, in use, the sluice gate operates as follows: assuming the gate is closed as shown in FIG. 2, the farmer may energise a radio transmitter to cause the valve actuator means to lift the valve and open the drain opening 22. Water then flows from the chamber 14 through the drain opening at a greater rate than it enters through the filler opening 21. Thus, the chamber empties and the closure element moves into the upper position allowing water to discharge onto the area to be flood irrigated. Once the water reaches a strategically placed monitoring device the device issues a similar signal. This causes the actuator means to close the valve, the chamber then fills through the filler opening 21, causing the closure element to move into the closed position.

It will be appreciated that sluice gates according to the invention may depart in detail from the described embodiment. For example the closure element may be differently shaped. It and the buoyancy chamber may be effectively a single component, for example a simple rectangular tank having a front wall that directly seals the gateway. Such a closure element may be secured to radius arms extending upstream to pivot means on mounting means that may be spaced from or separate from the gateway. The sealing plane may be inclined upwardly and forwardly, indeed the sealing arrangements need not lie in a single plane.

In other embodiments the filler opening may be valve controlled in lieu of, or as well as, the drain opening.

In less preferred embodiments the remote control means may be no more than a manually operable switch in a conventional low voltage power supply connected by wire conductors or the like to the valve actuator means.

As instances of further possibilities it is mentioned that the valve may be a butterfly or other valve in place of a plug valve.

Furthermore, the remote signal to the valve actuator may be a pneumatic or hydraulic signal sent by way of a flexible tube to the actuator. The actuator itself may be hydraulic or pneumatically powered, and may be an integral part of the valve.

I claim:

1. A sluice gate for controlling the discharge of liquid through a gateway, comprising mounting means defining a fixed substantially horizontal hinge axis upstream of the gateway, and substantially above a base of the gateway, a closure element mounted for swing movement about that axis and able to swing from a lower position wherein it blocks said gateway to an upper position wherein it allows liquid to flow through the gateway, a chamber fixedly associated with the closure element, a filler opening through which liquid from the upstream side of said gateway may enter said chamber, a drain opening through which liquid may drain from said chamber to the downstream side of said gateway, valve means controlling the flow of liquid through at least one of said openings, and valve actuator means responsive to a signal from a remote control means.

2. A sluice gate according to claim 1 wherein said mounting means comprise a flanged frame adapted to slide into a U-shaped sealing strip extending about a U-shaped gateway so as to define a discharge passage through the gateway that is smaller than the gateway itself.

3. A sluice gate according to claim 1 wherein said chamber is an integral part of said closure element.

4. A sluice gate according to claim 1 wherein said filler opening is smaller than said drain opening, and said valve means control the flow of liquid through said drain opening.

5. A sluice gate according to claim 1 wherein the valve actuator means are responsive to a radio signal.

* * * * *